US010517144B2

(12) United States Patent
Gomez

(10) Patent No.: US 10,517,144 B2
(45) Date of Patent: Dec. 24, 2019

(54) COOKTOP APPLIANCE AND TEMPERATURE SWITCH

(71) Applicant: Haier US Appliance Solutions, Inc., Wilmington, DE (US)

(72) Inventor: Eugenio Gomez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 356 days.

(21) Appl. No.: 15/455,183

(22) Filed: Mar. 10, 2017

(65) Prior Publication Data

US 2018/0259189 A1 Sep. 13, 2018

(51) Int. Cl.
*H05B 1/02* (2006.01)

(52) U.S. Cl.
CPC ..... *H05B 1/0213* (2013.01)

(58) Field of Classification Search
CPC ..... F24C 7/082; H05B 1/02; H05B 1/0266; H05B 3/748; H05B 3/0076; H05B 3/76; H05B 2213/04
USPC ..... 219/494, 490, 446.1, 448.11, 448.16, 219/448.18, 510
See application file for complete search history.

(56) References Cited

U.S. PATENT DOCUMENTS 3,622,754 A 11/1971 Hurko
4,755,655 A 7/1988 Reiche et al.
7,308,704 B2 * 12/2007 Vogel ..... G06F 21/604 726/1
9,214,798 B1 * 12/2015 Gawron, Sr. ..... F24C 7/083
9,220,130 B1 12/2015 Smith
2003/0094448 A1 * 5/2003 Shukla ..... H05B 1/0266 219/487
2006/0237434 A1 * 10/2006 Sterling ..... F24C 7/082 219/462.1
2011/0147366 A1 * 6/2011 Franca ..... H05B 3/68 219/443.1
2014/0048293 A1 * 2/2014 Luongo ..... A62C 3/006 169/65
2019/0051468 A1 * 2/2019 Turner ..... H01H 3/08

* cited by examiner

*Primary Examiner* — Mark H Paschall
(74) *Attorney, Agent, or Firm* — Dority & Manning, P.A.

(57) ABSTRACT

A cooktop appliance having a temperature switch is generally provided herein. The cooktop appliance may include a panel, an electric heating element, an infinite switch, and the temperature switch. The electric heating element may be positioned at the panel and include a first terminal and a second terminal. The infinite switch may be electrically coupled to the electric heating element to control power thereto. The infinite switch may include a primary voltage path and an auxiliary voltage path independent from the primary voltage path. The temperature switch disposed in thermal communication with the electric heating element, the temperature switch being in alternate communication with the primary voltage path below a predetermined threshold temperature and with the auxiliary voltage path at or above the predetermined threshold temperature.

18 Claims, 5 Drawing Sheets

COOKTOP APPLIANCE AND TEMPERATURE SWITCH

FIELD OF THE INVENTION

The present subject matter relates generally to cooktop appliances, and more particularly to electric cooktop appliances.

BACKGROUND OF THE INVENTION

Cooking appliances, such as, e.g., cooktops or ranges (also known as hobs or stoves), generally include one or more heated portions for heating or cooking food items within a cooking utensil placed on the heated portion. The heated portions utilize one or more heating sources to output heat, which is transferred to the cooking utensil and thereby to any food item or items within the cooking utensil. Typically, a controller or other control mechanism, such as an electromechanical switch, regulates the heat output of the heating source selected by a user of the cooking appliance, e.g., by turning a knob or interacting with a touch-sensitive control panel. For example, the control mechanism may cycle the heating source between an activated or on state and a substantially deactivated or off state such that the average heat output of the heating source corresponds to the user-selected heat output level.

The control mechanism can utilize a temperature sensor to help control the heat output in order to regulate or otherwise limit the cooking utensil from reaching an undesired temperature level. The transfer of heat to the cooking utensil and/or food items may cause the food items or cooking utensil to overheat or otherwise cause unwanted and/or unsafe conditions on the cooktop. Although conventional cooking appliances may include a safety feature for estimating temperature at the cooking utensil, such systems are often unable to provide a suitable evaluation of the current conditions near the burner or at a cooking utensil disposed thereon. Moreover, conventional appliances may be unable to quickly evaluate the current or "live" conditions near the burner. Undesirable swings in temperature may occur at the heating source and/or cooking utensil before conventional appliances are able to detect that an excessive or deficient temperature has been reached. For example, excessive temperatures may cause some food items to be burnt or overcooked. As another example, deficient temperatures may cause boiling water to lose water movement.

Accordingly, a cooktop appliance having a system for accurately detecting temperature conditions near a heat source would be desirable. More particularly, it may be desirable for a cooktop appliance to have a system that addresses one or more of the conditions discussed above.

BRIEF DESCRIPTION OF THE INVENTION

Aspects and advantages of the invention will be set forth in part in the following description, or may be obvious from the description, or may be learned through practice of the invention.

In one aspect of the present disclosure, a cooktop appliance is provided. The cooktop appliance may include a panel, an electric heating element, an infinite switch, and a temperature switch. The electric heating element may be positioned at the panel and include a first terminal and a second terminal. The infinite switch may be electrically coupled to the electric heating element to control power thereto. The infinite switch may include a primary voltage path and an auxiliary voltage path independent from the primary voltage path. The temperature switch disposed in thermal communication with the electric heating element, the temperature switch being in alternate communication with the primary voltage path below a predetermined threshold temperature and with the auxiliary voltage path at or above the predetermined threshold temperature.

In another aspect of the present disclosure, a cooktop appliance is provided. The cooktop appliance may include a panel, an electric heating element, a bimetallic temperature switch, and an infinite switch. The electric heating element may be positioned at the panel and extend between a first terminal and a second terminal. A bimetallic temperature switch may be positioned in thermal communication with the electric heating element. The bimetallic temperature switch may include a pole terminal alternately connected to a first throw terminal and a second throw terminal according to a temperature at the bimetallic temperature switch. The pole terminal may be electrically coupled in series with the second terminal. The infinite switch may be electrically coupled to the bimetallic temperature switch to control power at the electric heating element.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
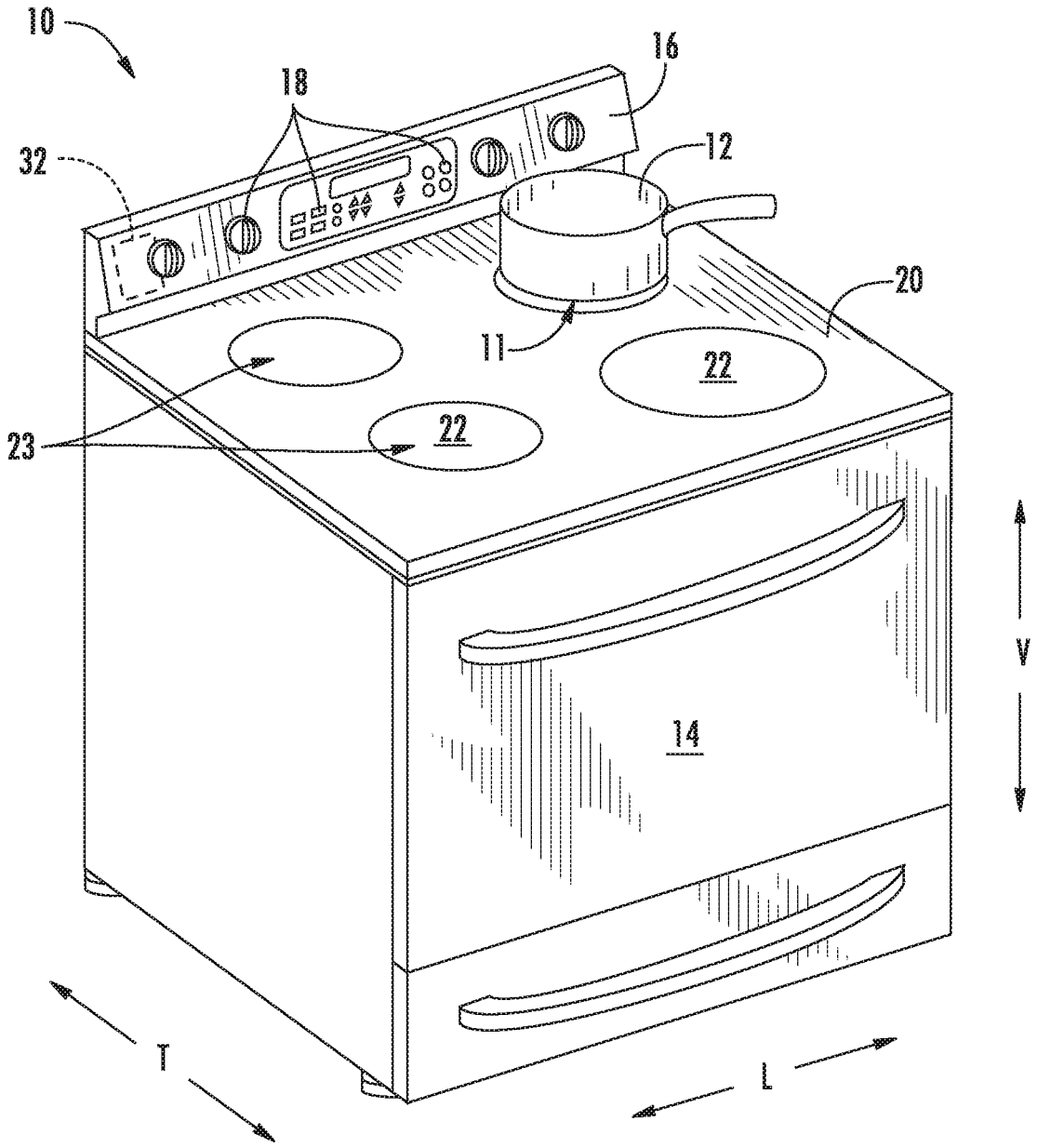
FIG. 1 provides a perspective view of a cooktop appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a cooktop appliance that includes at least one heating assembly. The heating assembly may have one or more electric heating elements and drip pan that is positioned below the electric heating element(s). A temperature switch may detect the heat transmitted from the electric heating element(s). The temperature switch may be connected to an infinite switch that has two separate duty cycle paths. When the temperature switch detects a certain temperature, it may connect to one duty cycle path. When the certain temperature is not detected, the temperature switch may connect to the other duty cycle path. For instance, if and/or when the temperature falls by a sufficient amount, the temperature switch may connect the electric heating element to the other of the two duty cycle paths.

Turning now to the figures, FIG. 1 provides a perspective view of an example cooktop appliance 10. Generally, cooktop appliance 10 defines a vertical direction V, a lateral direction L, and a transverse direction T. Each of the vertical direction V, lateral direction L, and transverse direction T may be mutually orthogonal to each other. As illustrated in FIG. 1, cooktop appliance 10 may be a range appliance that includes a horizontal cooking surface, such as a panel 20, disposed on and/or vertically above an oven cabinet. However, cooktop appliance 10 is provided by way of example only and is not intended to limit the present subject matter to any particular appliance or cooktop arrangement. Thus, the present subject matter may be used with other cooktop appliance configurations, e.g., cooktop appliances without an oven. Further, the present subject matter may be used in any other suitable appliance.

Panel 20 of cooktop appliance 10 includes one or more heating assemblies 22 having at least one heat zone 23. Panel 20 may be constructed of any suitable material, e.g., a ceramic, enameled steel, or stainless steel. As shown in FIG. 1, a cooking utensil 12, such as a pot, kettle, pan, skillet, or the like, may be placed or positioned on a heating assembly 22 to cook or heat food items placed within the cooking utensil 12. In some embodiments, cooktop appliance 10 includes a door 14 14 that permits access to a cooking chamber (not shown) of the oven cabinet of appliance 10, the cooking chamber for cooking or baking of food or other items placed therein.

Example embodiments include a user interface 16 having one or more control inputs 18 permits a user to make selections for cooking of food items using heating assemblies 22 and/or the cooking chamber. As an example, a user may manipulate one or more control inputs 18 to select, e.g., a power or heat output setting for each heating assembly 22. The selected heat output setting of heating assembly 22 affects the heat transferred to cooking utensil 12 positioned on heating assembly 22. Although shown on a backsplash or back panel of cooktop appliance 10, user interface 16 may be positioned in any suitable location, e.g., along a front edge of the appliance 10. Control inputs 18 may include one or more buttons, knobs, or touch screens, as well as combinations thereof.

Some embodiments further include a controller 32 operably connected (e.g., electrically coupled) to user interface 16 and/or control inputs 18. Generally, operation of cooking appliance 10, including heating assemblies 22, may be controlled by controller 32. In some embodiments, controller 32 is a processing device and may include a microprocessor or other device that is in operable communication with components of appliance 10, such as heating assembly 22. Controller 32 may include a memory and microprocessor, such as a general or special purpose microprocessor operable to execute programming instructions or microcontrol code associated with a selected heating level, operation, or cooking cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 32 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Control inputs 18 and other components of cooking appliance 10 may be in communication with (e.g., electrically coupled to) controller 32 via one or more signal lines or shared communication busses. Moreover, heating assembly 22 may be operably connected to controller 32, e.g., at one or more respective terminal pairs.

As will be described in further detail below, operation of heating assembly 22 may be regulated such that the temperature or heat output of heating assembly 22 corresponds to a temperate or heat output selected by a user of cooktop appliance 10. For example, one or more electric heating elements 21 (FIGS. 2 and 3) may be alternately cycled between an activated state and a deactivated state, i.e., between on and off, such that the average temperature or heat output over each cycle corresponds to or approximates the selected temperature or heat output. That is, a duty cycle of heating element 21 may be controlled such that, based on the user's selection, heating element 21 is activated or turned on for a fraction or portion of the duty cycle and deactivates or turns off heating element 21 for the remainder of the duty cycle. A user of cooktop appliance 10 may, e.g., manipulate a control 18 associated with a heating assembly 22 to select a desired heat output or temperature for heating element 21 of the associated heating assembly 22. The selection by the user indicates what fraction or portion of the duty cycle heating element 21 should be activated or on, e.g., if the user selects the midpoint heat output or temperature, the duty cycle of heating element 21 may be controlled such that heating element 21 is on for half of the duty cycle and off for half of the duty cycle.

Figure 2:
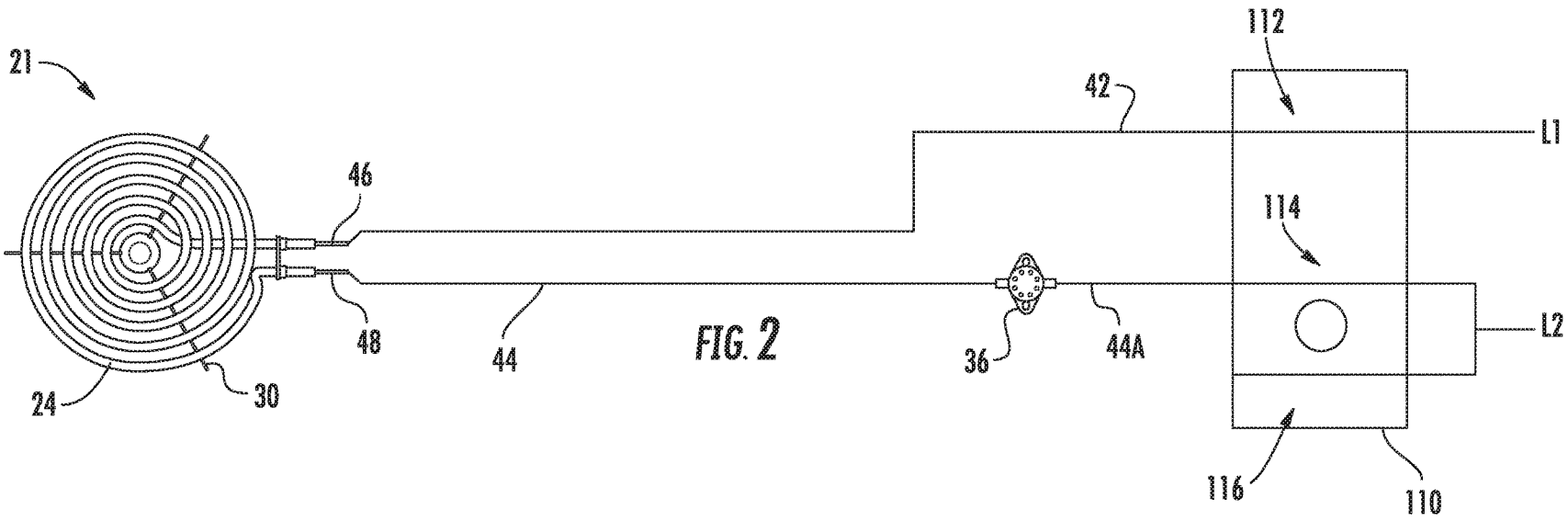
FIG. 2 provides a schematic view of a certain components for a cooktop appliance according to example embodiments of the present disclosure, wherein a temperature switch is provided in a first state.
Figure 3:
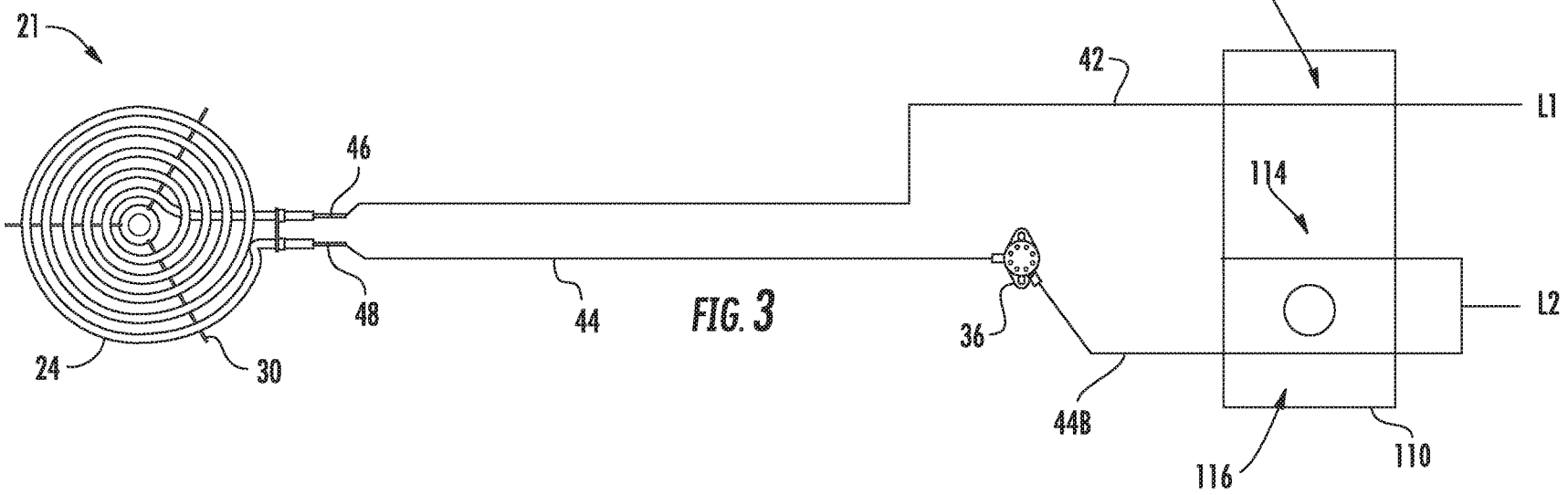
FIG. 3 provides a schematic view of the example components for a cooktop appliance of FIG. 2, wherein the temperature switch is provided in a second state.

As illustrated in FIGS. 2 and 3, some heating assembly 22 embodiments include an electric heating element 21 defining a heat zone 23 (FIG. 1). For instance, electric heating element 21 may be a single spiral shaped resistive coil for providing heat to a cooking utensil 12 (FIG. 1) positioned thereon. In some such embodiments, heating assembly 22 (FIG. 1) utilizes an exposed, electrically-heated, planar coil that is helically-wound about a center point. Coils act as a heat source, i.e., as electric heating element 21, for heating cooking utensils 12 placed directly on heating assembly 22.

A first terminal 46 and a second terminal 48 are provided for heating element 21. An electrical current may be transmitted to a resistive coil 24 at the terminals 46, 48. When a voltage differential is applied across first and second terminal 46, 48 of resistive coil 24, a temperature of electric heating element 21 increases. Resistive coil 24 may be a CALROD® coil in certain example embodiments.

Figure 4:
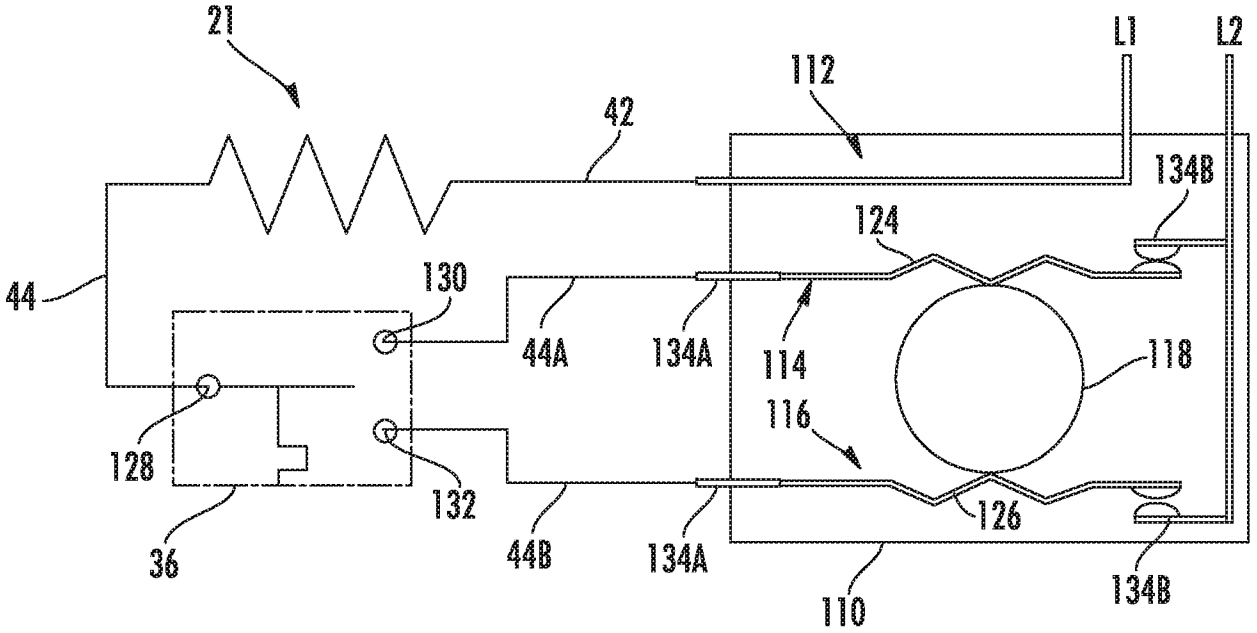
FIG. 4 provides a schematic view of an infinite switch for a cooktop appliance according to example embodiments of the present disclosure, wherein a temperature switch is provided in a second state.

In some embodiments, such as those illustrated at FIGS. 2 through 4, an infinite switch 110 is electrically coupled to heating element. Generally, infinite switch 110 may be included or in communication with controller 32 (FIG. 1) to control output of the heating element 21. Specifically, infinite switch 110 may vary or control the power output to heating element 22, e.g., according to a selection made at user inputs 18 (FIG. 1). A first voltage path 112 may be electrically coupled to first terminal 46 in series, e.g., through a static conductive member. A pair of secondary voltage paths 114, 116 may be alternately coupled to second terminal 48. A cam 118 may selectively vary the voltage at the secondary voltage paths 114, 116, as will be described in further detail below. For instance, cam 118 may be operably connected (e.g., directly attached) to a rotating knob or control input 18 (FIG. 1) such that rotation of control input 18 causes an identical or proportional rotation of cam 118.

First voltage path 112 is configured for operating at a first voltage, L1, with respect to ground. Thus, first electrical conduit 42 may be coupled or connected to a first voltage source operating at the first voltage L1 with respect to ground. The secondary voltage paths 114, 116 are formed in parallel and configured for operating at a second voltage, L2, with respect to ground. Thus, secondary voltage paths 114, 116 may be coupled or connected to a second voltage source operating at the second voltage L2 with respect to ground.

The first voltage L1 and the second voltage L2 have opposite polarities. In addition, a magnitude of the first voltage L1 with respect to ground may be about equal to a magnitude the second voltage L2 with respect to ground. As used herein, the term "about" corresponds to within ten volts of a stated voltage when used in the context of voltage. As an example, the magnitude of the first and second voltages L1, L2 may be about one hundred and twenty volts with respect to ground. Thus, first voltage path 112 may be coupled to one phase of a two-hundred and forty volt household electrical supply, and secondary voltage paths 114, 116 may be coupled to the second phase of the two-hundred and forty volt household electrical supply.

In some embodiments, the secondary paths include a primary voltage path 114 and an auxiliary voltage path 116. As shown, primary voltage path 114 and auxiliary voltage path 116 are generally independent of each other. For instance, primary voltage path 114 and auxiliary voltage path 116 may be assembled in parallel to each other. During use, each of primary voltage path 114 and auxiliary voltage path 116 may thus alternately operate at second voltage L2.

In further embodiments, primary voltage path 114 and auxiliary voltage path 116 each provide a unique duty cycle. For instance, primary voltage path 114 may be a high duty cycle path while auxiliary voltage path 116 is a low duty cycle path. In other words, primary voltage path 114 may permit a first power output over a duty cycle and auxiliary voltage path 116 may permit a second power output over another duty cycle.

In certain embodiments, each power output is a variable output. In other words, each of first power output and second power output provide a separate scale and/or maximum power output value. Nonetheless, it is understood that the second power output is generally less than the first power output. For instance, in some embodiments, the first power output has a 100% maximum output value while the second power output has a 50% maximum output value. In additional or alternative embodiments, the power output scale of the first power output spans 0% to 100% of a maximum output while the power output scale of the second power output spans 0% to 50% of a maximum output. During use, the duty cycle of the first power output activates or turns on heating element 21 for a first fraction or portion of the duty cycle and deactivates or turns off heating element 21 for the remainder of the duty cycle. The duty cycle of the second power output activates or turn on heating element 21 for a second fraction or portion of the duty cycle (e.g., that is less than that of the first duty cycle) and deactivates or turns off heating element 21 for the remainder of the duty cycle. Thus, the general, average, and/or median operating temperature of the first power output will be greater than the general, average, and/or median operating temperature of the second power output.

As shown in FIG. 4, primary voltage path 114 may include a first bimetal strip 124, and auxiliary voltage path 116 may include a second bimetal strip 126 that is electrically isolated from first bimetal strip 124. Generally, each of bimetal strips 124, 126 extends across a separate pair of conductive terminals (e.g., a fixed terminal 134A and a separable terminal 134B). Heat induced by current through the bimetal strips 124, 126 will deform the corresponding strip 124 or 126. Deformation will eventually cause the connection between the conductive terminal pair (e.g., at separable terminal 134B) to be broken and reestablished as the corresponding bimetal strip 124 or 126 cools.

In some embodiments, a rotatable cam 118 variably biases one or both of bimetal strips 124, 126 towards a respective conductive terminal 134B, as shown in FIG. 4. Although shown schematically as having a circular profile, it is understood that cam 118 may be shaped to include a variable cam width. During use, bimetal strips 124, 126 may be biased closer or further from the respective conductive terminal based on the rotational position of cam 118. In other words, contact with the profile of the cam 118 may determine the distance between each bimetal strip 124, 126 and its respective conductive terminal 134B. Generally, first bimetal strip 124 is biased closer to its respective conductive terminal 134B than second bimetal strip 126 is biased to its own respective conductive terminal 134B. The bias or position of each bimetal strip 124, 126 may be dictated by the portion of the cam profile which contacts each bimetal strip 124, 126 at a given rotational position of cam 118. The active period or fraction of the duty cycle(s) is increased as bimetal strips 124, 126 are each moved closer to the respective conductive terminal 134B. Thus, the rotational position of cam 118 may generally vary or control the duty cycle or power output at each bimetal strip 124, 126.

Returning to FIGS. 2 and 3, a temperature switch 36 is generally provided as a safety mechanism separate from the controller 32. In some embodiments, temperature switch 36 is positioned adjacent electric heating element 21, as will be described in detail below. Generally, temperature switch 36 may be positioned such that a temperature of temperature switch 36 corresponds to a temperature of heating assembly 22 or cooking utensil 12 (FIG. 1) above heating assembly 22. Thus, temperature switch 36 may be configured for detecting the temperature of heating assembly 22 or cooking utensil 12 above electric heating element 21.

Temperature switch 36 may generally be operable to alternate a connection between voltage paths 114, 116 and electric heating element 21 at a predetermined temperature. In some such embodiments, temperature switch 36 includes a pole terminal 128, as well as a first throw terminal 130 and a second throw terminal 132. For instance, temperature switch 36 may be provided as a single pole double throw switch. As shown, temperature switch 36 is electrically coupled to infinite switch 110. In specific embodiments, the first throw terminal 130 of temperature switch 36 is electrically coupled to primary voltage path 114, and second throw terminal 132 of temperature switch 36 is electrically coupled to auxiliary voltage path 116. According to the temperature, pole terminal 128 may actuate between first throw terminal 130 and second throw terminal 132. Thus, some embodiments of temperature switch 36 are in alternate communication with the primary voltage path 114 and the auxiliary voltage path 116.

Temperature switch 36 is generally provided as a temperature-responsive member. When assembled, temperature switch 36 may configured for actuating from a first, e.g., high duty cycle, state (FIG. 2) to a second, e.g., low duty cycle, state (FIG. 3), based on the detected temperature. For instance, a threshold temperature may be provided for temperature switch 36. As noted above, temperature switch 36 may be in alternate communication with the primary voltage path 114 and the auxiliary voltage path 116. In specific embodiments, temperature switch 36 is in communication with the primary voltage path 114 below the predetermined threshold temperature and in communication with the auxiliary voltage path 116 at or above the predetermined threshold temperature. Advantageously, the heating element 21 and/or the surrounding area may be prevented from reaching or maintaining an undesirable temperature that might, for example, permit ignition of food items (e.g., oil) that have accumulated near or below heating element 21.

Optional embodiments of temperature switch 36 are provided as a bimetallic switch, e.g., as a single pole double throw bimetallic switch. A bimetallic member within temperature switch 36 may thus actuate or adjust from the first state to the second state when the temperature of temperature switch 36 exceeds the threshold temperature. The materials of temperature switch (e.g., the bimetallic member) may be selected to such that temperature switch 36 triggers or trips between first throw terminal 130 and second throw terminal 132 at the threshold temperature.

It is understood that the threshold temperature may be any suitable temperature. For example, the threshold temperature may be about three hundred and twenty-five degrees Celsius. As another example, the threshold temperature may be between about ninety degrees Celsius and about four hundred degrees Celsius. As used herein, the term "about" corresponds to within twenty-five degrees of a stated temperature when used in the context of temperature. The threshold temperature may be may be selected such that the threshold temperature accounts for a position of temperature switch 36 relative to heating assembly 22 and/or cooking utensil 12 (FIG. 1) above electric heating element 21.

A first electrical conduit 42 is coupled to first terminal 46 of electric heating element 21. For instance, a portion of first electrical conduit 42 may extend in series between first terminal 46 and infinite switch 110 (e.g., at first voltage path 112). In some such embodiments, first electrical conduit 42 is configured for operating at first voltage, L1, with respect to ground. Thus, first electrical conduit 42 may be coupled or connected to the first voltage source operating at the first voltage L1 with respect to ground.

A second electrical conduit 44 configured for operating at second voltage, L2, with respect to ground. For instance, a portion of second electrical conduit 44 may extend in series between second terminal 48 and temperature switch 36 (e.g., at pole terminal 128). One branch 44A of second electrical conduit 44 may extend in series from first throw terminal 130 to the primary voltage path 114 of infinite switch 110. Another branch 44B of second electrical conduit 44 may extend in series from second throw terminal 132 to the auxiliary voltage path 116 of infinite switch 110. Thus, second electrical conduit 44 may be coupled or connected to the second voltage source operating at the second voltage L2 with respect to ground. The first and second electrical conduits 42, 44 may be any suitable electrical conduits, such as wires, cables, etc.

As described above, temperature switch 36 may selectively adjust between a first and second state. Accordingly, temperature switch 36 may selectively and alternately couple or connect second terminal 48 to primary voltage path 114 and auxiliary voltage path 116. Thus, at a given time, temperature switch 36 can be electrically coupled to only one of primary voltage path 114 and auxiliary voltage path 116. When temperature switch 36 is electrically coupled to primary voltage path 114, temperature switch 36 will be isolated from auxiliary voltage path 116. By contrast, when temperature switch 36 is electrically coupled to auxiliary voltage path 116, temperature switch 36 will be isolated from primary voltage path 114. Based on the temperature, temperature switch 36 may be uncoupled from primary voltage path 114 for coupling with auxiliary voltage path 116, or uncoupled from auxiliary voltage path 116 for coupling with primary voltage path 118. By selectively and alternatively coupling or connecting the second terminal 48 of electric heating element 21 to primary voltage path 114 and auxiliary voltage path, a duty cycle or power output of electric heating element 21 may be varied with temperature switch 36.

Advantageously, power output and temperature may be reduced during use without completely removing power to electric heating element 21. Moreover, temperature swings at heating element 21 may be reduced without the use of multiple coils or additional heating elements.

As illustrated in the example embodiments of FIGS. 2 through 3, each electric heating element(s) 21 may be supported on one or more support elements 30, which also help support cooking utensil 12 (FIG. 1) when the cooking utensil 12 is placed on panel 20 (FIG. 1). Further, although illustrated as forming a spiral shape by winding in coils around a center point, each resistive coil 24 may have a different number of turns, other shapes, or other configurations as well. Heating assemblies 22 may have any suitable shape, size, and number of defined heating zones 23. Optionally, each heating assembly 22 of cooking appliance 10 (FIG. 1) may be heated by the same type of heating source, or cooking appliance 10 may include a combination of different types of heating sources. Cooking appliance 10 may include a combination of heating assemblies 22 of different shapes and sizes.

Figure 5:
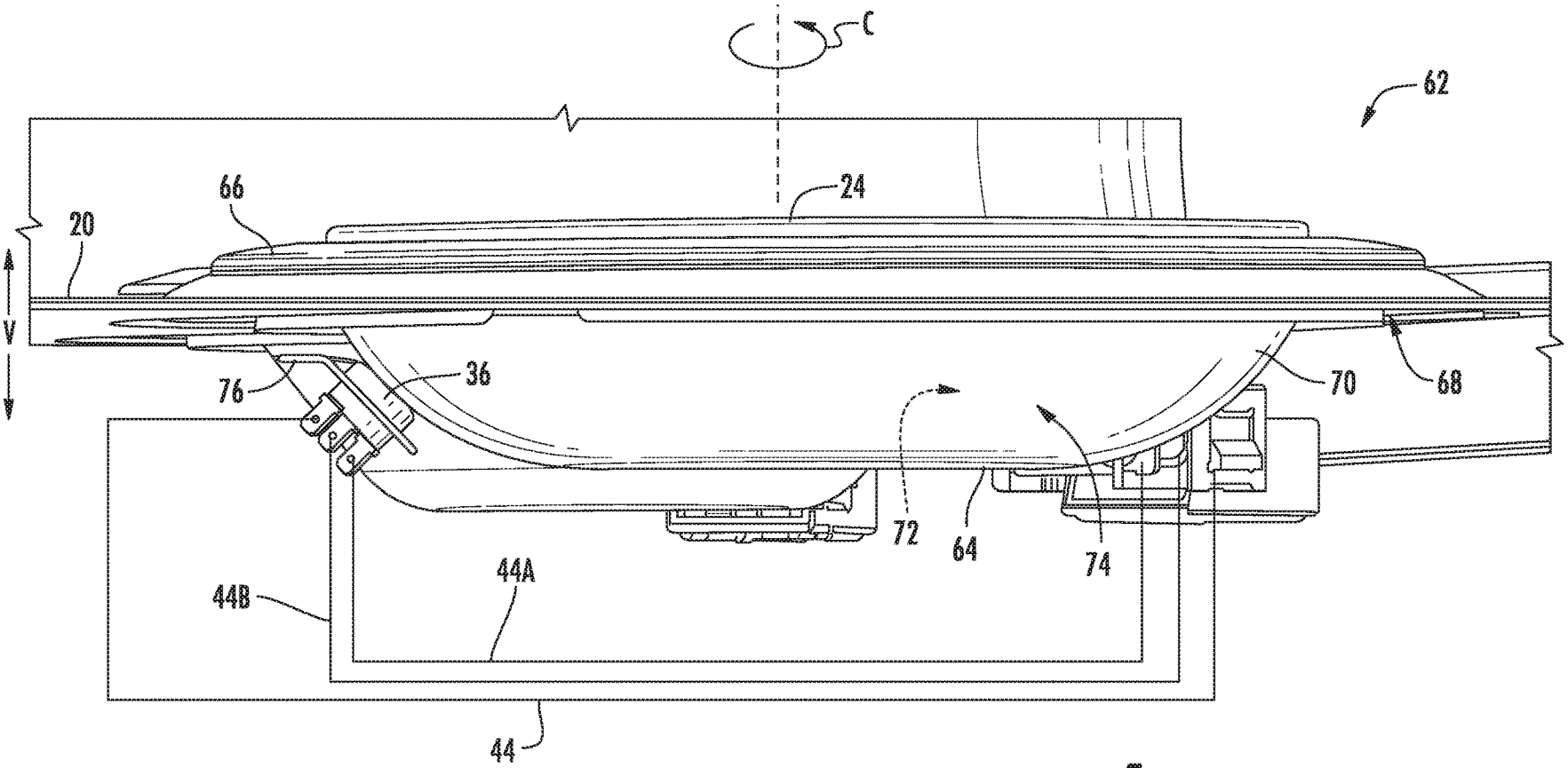
FIG. 5 provides a side perspective view of a heating assembly in a cooktop appliance according to example embodiments of the present disclosure.
Figure 6:
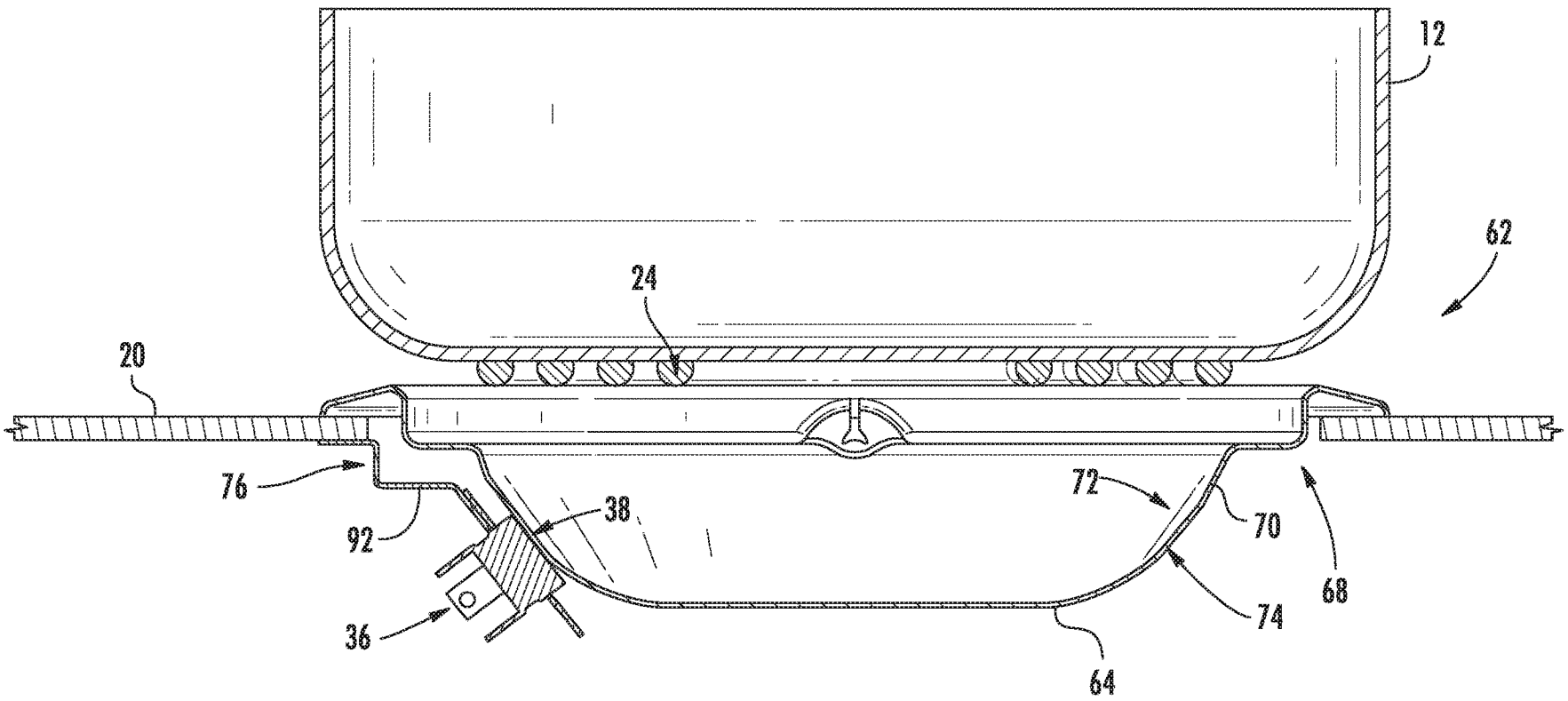
FIG. 6 provides a cross-sectional view of a heating assembly in a cooktop appliance according to example embodiments of the present disclosure.

Turning now to FIGS. 5 and 6, an example heating assembly 62 is illustrated. It is understood that heating assembly 62 may generally correspond to the heating assembly 22 of cooktop appliance 10 (FIG. 1). As shown, some embodiments of heating assembly 62 may include an electric heating element 21 positioned at panel 20. For instance, at least a portion of electric heating element 21 may be positioned above hole 68 defined through panel 20. A drip pan 64 may be attached (e.g., removably attached) to panel 20 below electric heating element 21. In some embodiments, drip pan 64 includes a support lip 6 extending along a circumferential direction C to rest on a top surface of panel 20, e.g., about hole 68. When mounted, a concave sidewall 70 may extend below panel 20. For example, a portion of concave sidewall 70 may extend through hole 68 from support lip 6. Concave sidewall 70 may include an inner surface 72 facing the hole 68 and/or electric heating element 21. An outer surface 74 of concave sidewall 70 may be positioned opposite inner surface 72 to face away from hole 68 and/or electric heating element 21. A pan aperture may be defined at a bottom portion of concave sidewall 70 to extend therethrough from inner surface 72 to outer surface 74.

In some embodiments, a switch bracket 76 is provided to hold temperature switch 36. Optionally, switch bracket 76 may include a support tab 92 attached to the panel 20. Temperature switch 36 may be mounted to the support tab 92 at a fixed position relative to the panel 20. In other words, temperature switch 36 may remain stationary relative to the support tab 92 and panel 20, regardless of whether temperature switch 36 engages drip pan 64. In alternative embodiments, support tab 96 may be formed as or include a resilient elastic member to bias switch bracket to drip pan 64. In further additional or alternative embodiments, switch bracket 76, including support tab 92, is mounted directly to a burner box (not pictured), or another suitable support member disposed below drip pan 64.

When assembled in an engaged state, temperature switch 36 may contact drip pan 64. For instance, temperature switch 36 may contact outer surface 74 of drip pan 64. A flat face-plate 38 may directly contact a portion of outer surface 74 of concave sidewall 70. Advantageously, temperature switch 36 may be able to quickly detect and respond to variations in temperature at drip pan 64 and electric heating element 21. Moreover, flat face-plate 38 may allow a point of constant contact between concave sidewall 70 and temperature switch 36, regardless of movement or tolerances of drip pan 64.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a panel;

an electric heating element positioned at the panel, the electric heating element comprising a first terminal and a second terminal for connection to a power supply, the second terminal connected in series with the first terminal, a voltage differential being applicable between the first terminal and the second terminal to control heat at the electric heating element;

an infinite switch electrically coupled to the electric heating element to control power thereto, the infinite switch comprising a primary voltage path and an auxiliary voltage path independent from the primary voltage path; and a temperature switch disposed in thermal communication with the electric heating element, the temperature switch being in alternate communication with the primary voltage path below a predetermined threshold temperature and with the auxiliary voltage path at or above the predetermined threshold temperature, wherein the temperature switch comprises a pole terminal, a first throw terminal, and a second throw terminal, the pole terminal being electrically coupled to the electric heating element, the first throw terminal being electrically coupled to the primary voltage path, the second throw terminal being electrically coupled to the auxiliary voltage path, and wherein the pole terminal is actuatable between the first throw terminal and the second throw terminal according to a temperature at the temperature switch.

2. The cooktop appliance of claim 1, wherein the temperature switch is a bimetallic temperature switch.

3. The cooktop appliance of claim 1, wherein the electric heating element is a single coil heating element.

4. The cooktop appliance of claim 1, wherein the primary voltage path is a high duty cycle path permitting a first power output, and wherein the auxiliary voltage path is a low duty cycle path permitting a second power output, the second power output being less than the first power output.

5. The cooktop appliance of claim 1, wherein the primary voltage path comprises a first bimetal strip, and wherein the auxiliary voltage path comprises a second bimetal strip in electric isolation from the first bimetal strip.

6. The cooktop appliance of claim 1, further comprising a drip pan attached to the panel and positioned below the electric heating element, wherein the temperature switch is positioned in thermal engagement with the drip pan.

7. The cooktop appliance of claim 6, further comprising a switch bracket extending below the panel, wherein the temperature switch is supported on the switch bracket.

8. The cooktop appliance of claim 7, wherein the temperature switch is mounted in direct contact with the drip pan.

9. The cooktop appliance of claim 8, wherein the drip pan comprises a concave sidewall, and wherein the temperature switch comprises a flat face-plate in contact with the concave sidewall.

10. A cooktop appliance comprising:

a panel;

an electric heating element positioned at the panel, the electric heating element extending between a first terminal and a second terminal for connection to a power supply, the second terminal connected in series with the first terminal, a voltage differential being applicable between the first terminal and the second terminal to control heat at the electric heating element;

a bimetallic temperature switch positioned in thermal communication with the electric heating element, the bimetallic temperature switch comprising a pole terminal electrically coupled in series with the second terminal; and an infinite switch electrically coupled to the bimetallic temperature switch to control power at the electric heating element, the infinite switch comprising a primary voltage path and an auxiliary voltage path independent from the primary voltage path, wherein the first throw terminal is electrically coupled to the primary voltage path, wherein the second throw terminal is electrically coupled to the auxiliary voltage path, and wherein the pole terminal is actuatable between the first throw terminal and the second throw terminal according to a temperature at the bimetallic temperature switch.

11. The cooktop appliance of claim 10, wherein the electric heating element is a single coil heating element.

12. The cooktop appliance of claim 10, wherein the primary voltage path comprises a high duty cycle path and the auxiliary voltage path comprises a low duty cycle path, the high duty cycle path permitting a first power output, and low duty cycle path permitting a second power output, the second power output being less than the first power output.

13. The cooktop appliance of claim 12, wherein the high duty cycle path comprises a first bimetal strip, and wherein the low duty cycle path comprises a second bimetal strip in electric isolation from the first bimetal strip.

14. The cooktop appliance of claim 13, wherein the pole terminal is electrically coupled to the electric heating element, wherein the first throw terminal is electrically coupled to the high duty cycle path, the wherein the second throw terminal is electrically coupled to the low duty cycle path.

15. The cooktop appliance of claim 10, further comprising a drip pan attached to the panel and positioned below the electric heating element, wherein the bimetallic temperature switch is positioned in thermal engagement with the drip pan.

16. The cooktop appliance of claim 15, further comprising a switch bracket extending below the panel, wherein the bimetallic temperature switch is supported on the switch bracket.

17. The cooktop appliance of claim 16, wherein the bimetallic temperature switch is mounted in direct contact with the drip pan.

18. The cooktop appliance of claim 17, wherein the drip pan comprises a concave sidewall, and wherein the bimetallic temperature switch comprises a flat face-plate in contact with the concave sidewall.

* * * * *